US011053656B1

(12) United States Patent
Anderson et al.

(10) Patent No.: US 11,053,656 B1
(45) Date of Patent: Jul. 6, 2021

(54) METHOD OF MAKING MOLDED CONCRETE BLOCKS HAVING SIMULATED BRICK OR STONE OUTER SURFACES

(71) Applicant: Mortarless Technologies LLC, Rochester, MN (US)

(72) Inventors: Edward J. Anderson, Littleton, CO (US); Geoffrey S. Parrington, Thornton, CO (US); Dion T. DeMeyer, Erie, CO (US)

(73) Assignee: Mortarless Technologies LLC, Rochester, MN (US)

( * ) Notice: Subject to any disclaimer, the term of this patent is extended or adjusted under 35 U.S.C. 154(b) by 262 days.

(21) Appl. No.: 15/699,907

(22) Filed: Sep. 8, 2017

Related U.S. Application Data

(62) Division of application No. 14/176,991, filed on Feb. 10, 2014, now Pat. No. 9,758,943.

(60) Provisional application No. 61/762,685, filed on Feb. 8, 2013.

(51) Int. Cl.

| | |
|---|---|
| ***B28B 7/10*** | (2006.01) |
| ***E02D 29/02*** | (2006.01) |
| *B28B 7/06* | (2006.01) |
| *B28B 7/00* | (2006.01) |
| *B28B 7/34* | (2006.01) |

(52) U.S. Cl.
CPC ..... *E02D 29/0266* (2013.01); *B28B 7/10* (2013.01); *B28B 7/007* (2013.01); *B28B 7/06* (2013.01); *B28B 7/348* (2013.01); *E02D 29/025* (2013.01)

(58) Field of Classification Search
CPC ... E02D 29/025; E02D 29/0266; B28B 7/007; B28B 7/06; B28B 7/10; B28B 7/348
See application file for complete search history.

(56) References Cited

U.S. PATENT DOCUMENTS

| | | | |
|---|---|---|---|
| 599,786 | A | 3/1898 | Katz |
| 1,993,291 | A | 3/1935 | Vermont |
| 3,426,122 | A | 2/1969 | Gaudelli et al. |
| 3,595,518 | A | 7/1971 | Gaudelli et al. |
| 3,883,109 | A | 5/1975 | Hahne |
| 4,193,718 | A | 3/1980 | Wahrendorf |
| 4,512,685 | A | 4/1985 | Hegle |
| 4,647,000 | A | 3/1987 | Osada |
| 5,066,169 | A | 11/1991 | Gavin |
| 5,161,918 | A | 11/1992 | Hodel |
| 5,350,256 | A | 9/1994 | Hammer |

(Continued)

FOREIGN PATENT DOCUMENTS

| | | |
|---|---|---|
| WO | WO8807920 | * 10/1988 |

OTHER PUBLICATIONS

WO8807920 machine translation (Year: 1988).*

*Primary Examiner* — Timothy Kennedy
*Assistant Examiner* — Alexander A Wang
(74) *Attorney, Agent, or Firm* — Fish & Richardson P.C.

(57) ABSTRACT

A method of forming simulated stone or brick column or a retaining wall is made up of rows of masonry blocks of generally trapezoidal configuration arranged in end-to-end relation to one another in each row, each block including a recessed portion being aligned with one another in each row and each block having textured wall surfaces simulating the appearance of brick or stone along one or more wall surfaces arranged in different configurations without the necessity of interlocking the blocks together.

20 Claims, 4 Drawing Sheets

(56) References Cited

U.S. PATENT DOCUMENTS 5,417,523 A 5/1995 Scales
5,505,034 A 4/1996 Dueck
5,622,456 A 4/1997 Risi
5,788,423 A 8/1998 Perkins
5,820,304 A 10/1998 Sorheim et al.
D403,437 S 12/1998 Risi
5,843,327 A * 12/1998 Lindgren ..... E04G 11/087 249/210
5,945,053 A * 8/1999 Hettinga ..... E05D 1/02 264/171.13
6,082,933 A 7/2000 Maguire
6,224,295 B1 5/2001 Price
6,616,382 B2 9/2003 Woolford et al.
6,827,527 B2 12/2004 Conkel
6,884,004 B1 4/2005 Scales
7,267,321 B1 9/2007 Morrell
7,549,616 B1 6/2009 Koren
7,553,109 B2 6/2009 Blundell
7,618,578 B2 11/2009 Manthei et al.
7,687,006 B2 3/2010 Manthei et al.
7,931,248 B2 4/2011 Korwin-Edson et al.
8,101,113 B2 1/2012 Castonguay et al.
2001/0019684 A1 9/2001 Manthei
2003/0070386 A1 4/2003 Hampton
2003/0160147 A1 8/2003 Manthei
2003/0164574 A1 9/2003 Hammer et al.
2004/0074167 A1 4/2004 Drost
2005/0086892 A1 4/2005 Dean
2006/0096180 A1 5/2006 Price
2007/0045897 A1 3/2007 Alexander et al.
2007/0258776 A1 11/2007 Strand
2008/0095584 A1 4/2008 Strand
2008/0260474 A1 10/2008 Koster
2008/0272132 A1 11/2008 Afflerbach et al.
2009/0094917 A1 4/2009 McIntosh
2009/0185870 A1 7/2009 Shaw
2010/0133725 A1* 6/2010 McCaskey ..... B28B 7/346 264/299
2011/0013991 A1 1/2011 Watson
2011/0217127 A1 9/2011 MacDonald
2012/0057939 A1 3/2012 Bone
2012/0126451 A1* 5/2012 Owen ..... B28B 7/007 264/225

* cited by examiner

METHOD OF MAKING MOLDED CONCRETE BLOCKS HAVING SIMULATED BRICK OR STONE OUTER SURFACES

This application is a divisional of Ser. No. 14/176,991, filed 10 Feb. 2014 titled MOLDED CONCRETE BLOCKS HAVING SIMULATED BRICK OR STONE OUTER SURFACES AND METHOD OF MAKING SAME (now U.S. Pat. No. 9,758,943), which claims the benefit of U.S. Provisional Application No. 61/762,685 filed Feb. 8, 2013 for COMPOSITE MOLDED CONCRETE BLOCKS HAVING TEXTURED FRONT SURFACES DEFINING SIMULATED BRICK OR STONE AND MORTAR CLUSTERS AND METHOD OF MAKING SAME and is incorporated by reference herein.

BACKGROUND AND FIELD

There is a need for concrete or masonry blocks which can be molded with different textured surfaces and combined to form retaining walls of different sizes and configurations in a simplified, efficient manner. In this regard, it is highly desirable to form each block in a mold which is positioned to provide a textured finished face for each block in a front vertical wall of the mold, and the remainder of the side and end wall surfaces of the mold inclining downwardly and inwardly to result in the formation of downwardly tapered side and rear walls in the resultant block in order to facilitate removal of the block from the mold. In order to further expedite removal of each block, a hinge is provided in opposite sides or along the bottom of each mold together with placement of cavities in the bottom and rear walls of each block in a manner to be described. One or more molds may be placed on a production board, the molds preferably being formed of a rubber or rubber-like material, and the blocks are formed by a wetcast process followed by curing and separation from each mold. In particular, the concrete block is of generally trapezoidal configuration with a front textured surface which takes on the appearance of a brick, stone and mortar cluster, different stone or rock-like textures. Each block is characterized also by having a rear wall and sidewalls joined together into a trapezoidal configuration, and the blocks can be arranged in various configurations, such as, for example, straight, rectangular, circular or serpentine walls without the necessity of inter-locking or otherwise physically joining the blocks together.

When used for retaining walls, a typical block is dimensioned to be 16" wide by 6" high at the front wall surface 12 and 8" to 9" in depth from the front surface 12 to the rear surface 14 depending upon the depth of the texture and the slope at the rear of the block 10 and will weigh in the order of thirty to fifty pounds each, although dimensions and weights may vary without departing from the scope. If necessary, the blocks can be joined by the application of construction adhesive between layers of block to prevent shifting in relation to each other. For taller retaining walls the blocks can also be anchored into the earth fill behind the wall by the use of a geogrid material that will extend between upper and lower layers of blocks. In addition, rods may be placed under each geogrid and within the void on the underside of each block and further anchored by the use of the elongated rods positioned against the geogrid in each void and locked in place by means of friction or pinch points between each rod and void. Both the geogrid and rod for each layer will extend continuously in a lengthwise direction beneath each row of blocks although these may be alternated as well. Also, the rods should be flexible enough to permit shaping of the entire wall into different configurations.

There is provided a method for molding a concrete block comprising the steps of: providing an outer rigid form having upstanding front and rear walls and opposite end walls arranged in a generally rectangular configuration; an elastomeric insert having a generally rectangular cavity defining front and rear wall surfaces and opposite end surfaces removably inserted into the form, at least one of the front, rear and end wall surfaces having a desired texture simulating a brick or stone to a block to be cast in said cavity; providing an upper opening into the cavity and filling the cavity with a wet cast colored concrete; vibrating the mold to densify and level out the concrete in the mold; curing the concrete in the mold over a predetermined time interval to form a hardened block of concrete; and removing the block from the mold.

DETAILED DESCRIPTION OF EMBODIMENTS

Figure 1:
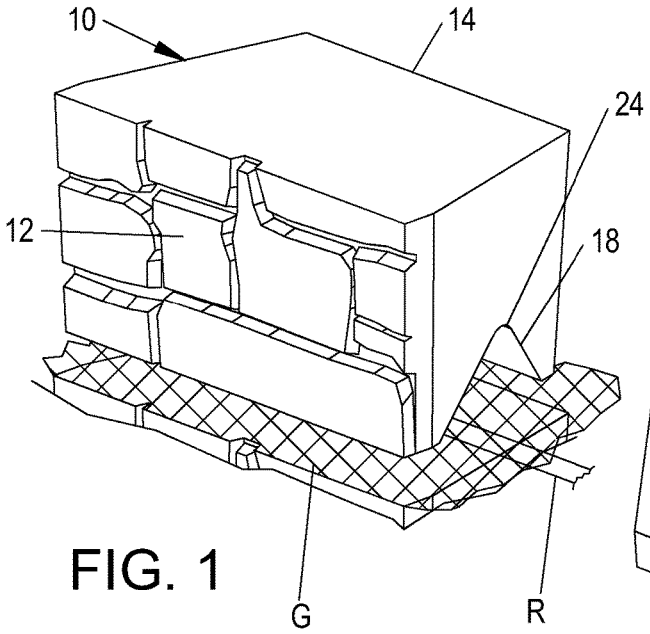
FIG. 1 is a front perspective view of one form of concrete block illustrating placement of a geogrid and rod into a void in the undersurface of each block in accordance with one aspect.
Figure 2:
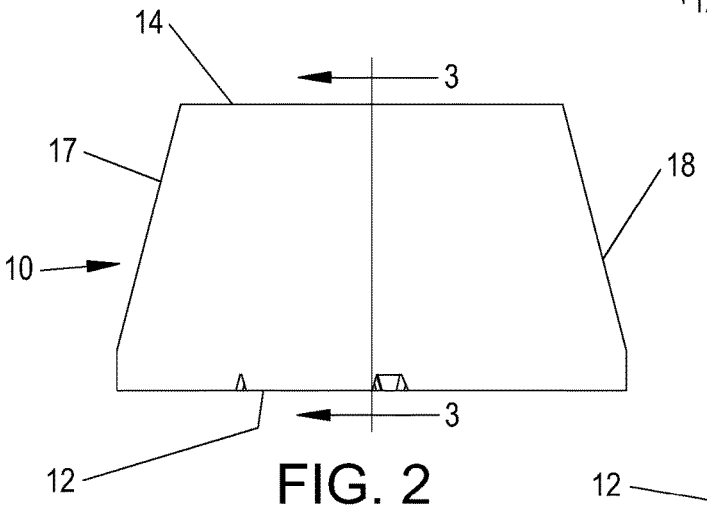
FIG. 2 is a top plan view of FIG. 1.
Figure 3:
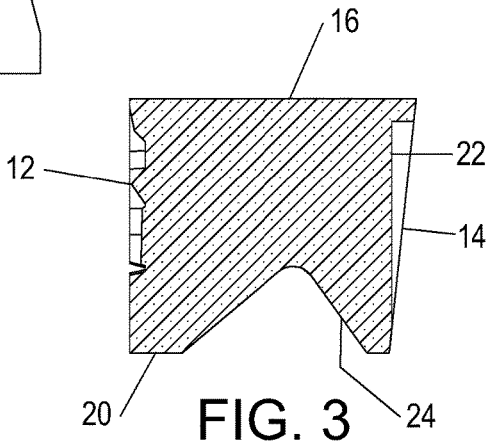
FIG. 3 is a cross sectional view taken about lines 3-3 of FIG. 2.

Referring in detail to the drawings, a composite concrete or masonry block 10 is illustrated in FIGS. 1-3 and comprises a front textured wall surface 12 and a rear wall surface 14 which is tapered downwardly from a top horizontal surface 16. Similarly, opposite sidewalls 17 and 18 are generally rectangular or trapezoidal in shape and taper downwardly from the top surface 16, and along with the front and rear surfaces 12 and 14 terminate in a bottom horizontal surface 20 which is parallel to the top surface 16. It will be evident by virtue of the downwardly tapered rear surface 14 and sidewall surfaces 17 and 18 which terminate in adjoining relation to the bottom surface 20 that the area or size of the bottom surface is less than the area of the top surface. Nevertheless, by virtue of the perpendicular relationship between the front surface 12 and the bottom surface 20, the frontal surface is upstanding or vertical when the bottom surface 20 is resting upon a horizontal surface, such as, level ground or on the level top surface of a lower adjoining block of a retaining wall as will be hereinafter described.

Preferably, the rear surface 14 is formed with a cavity 22 and the bottom surface is formed with a cavity 24 that extends the length of the bottom surface 20 to reduce the weight of each block and facilitate gripping of the rear surface to remove from the mold and for carrying purposes.

Figure 4:
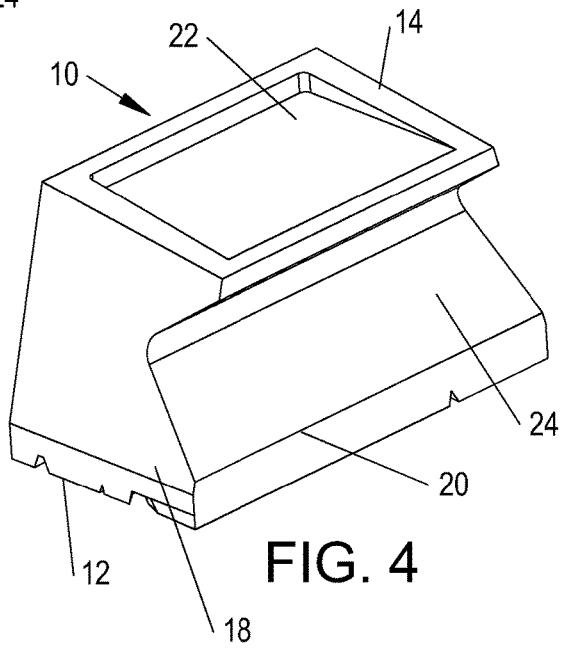
FIG. 4 is a rear view of FIG. 1.
Figure 5:
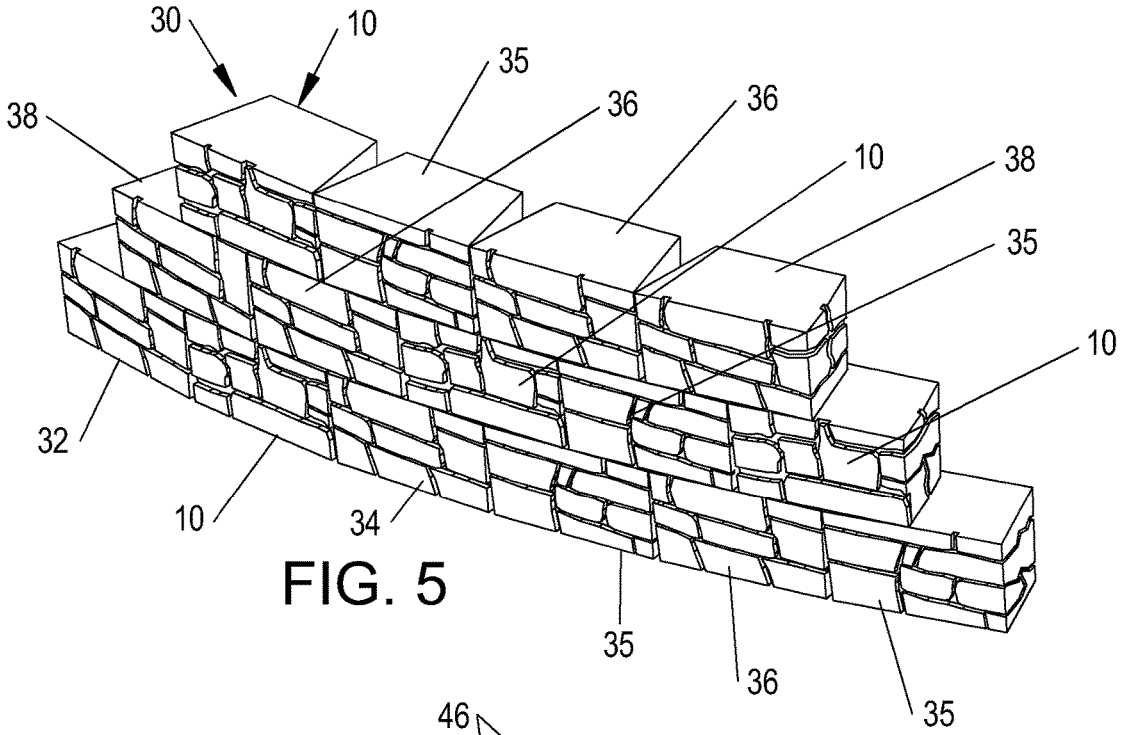
FIG. 5 is a perspective view of a retaining wall comprised of a number of composite blocks having different textured frontal surfaces and end surfaces.

For the purpose of illustration but not limitation, FIGS. 4 and 5 illustrate the utilization of concrete blocks 10 of the present invention in the construction of a retaining wall 30. Typically, the finished dimension of each block 10 may be on the order of 16" wide by 6" high at the front wall surface 12 and 8" to 9" in depth from the front surface 12 to the rear surface 14 depending upon the depth of the texture and the slope at the rear of the block 10. Again, the voids or cavities 22 and 24 in each block on the rear surface 14 and bottom surface 20 serve to reduce the overall weight of each block 10 by reducing the amount of material required without reducing the overall dimensions of each block. Also, the cavity 22 serves as a lifting handle to assist in lifting the retaining wall block from the mold without disturbing the overall dimensions of the block, along with the use of a vacuum to hold the stone while the mold is being removed by hand. The mold may also be removed manually by turning the mold over and allowing the block to be removed by gravity pull.

Figure 12:
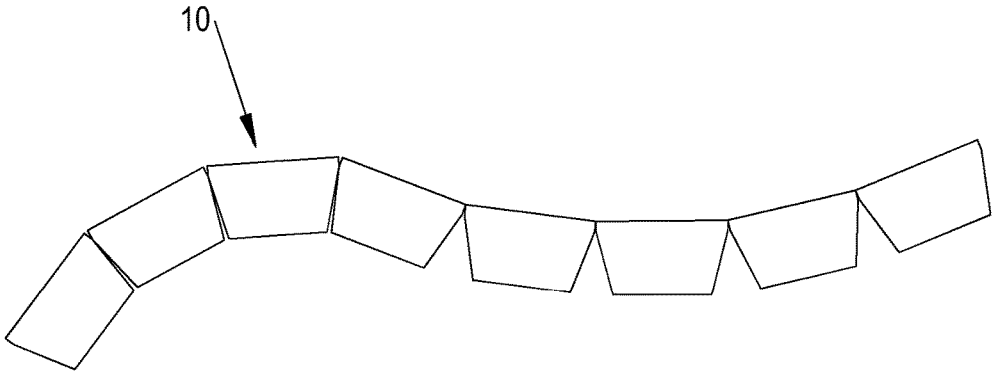
FIG. 12 is a top plan view of a retaining wall in a serpentine form.

In the retaining wall structure illustrated in FIG. 5, like blocks are correspondingly enumerated. Thus, the lower course of blocks 32, 10, 34, 35 and 36 are placed on a level surface either above or below ground level to establish a firm footing for the retaining wall. The next course consisting of blocks 38, 36, 10, and 35 may be placed directly on the top surfaces 20 of the first course and an upper course comprises blocks 10, 35, 36 and 38. When erected along a straight or curved line the upper front chamfered vertical edges of the adjoining or adjacent blocks are positioned flush with one another with a slight gap between facing sidewalls as a result of the tapered configuration of the sidewalls as described earlier. Blocks can be joined by use of construction adhesives between the layers to prevent movement in relation to one another. Of course, if the retaining wall is curved to any degree or serpentine as shown in FIG. 12, the upper edges and adjoining edges will not be completely flush with one another but the chamfered front vertical corners and the wedge shape of the block itself allows for easy configuration of the curved wall.

Variations of texture as illustrated in FIGS. 4 and 5 will be hereinafter discussed in greater detail in connection with the method of manufacture, and the same is true of the composition of the concrete and additives utilized to control the characteristics of the concrete all in accordance with well known practice. Thus any variety of concrete mixture can be used depending upon the desired strength, color and other characteristics to be incorporated into the blocks.

Molds and Method of Manufacturing Blocks

Figure 6:
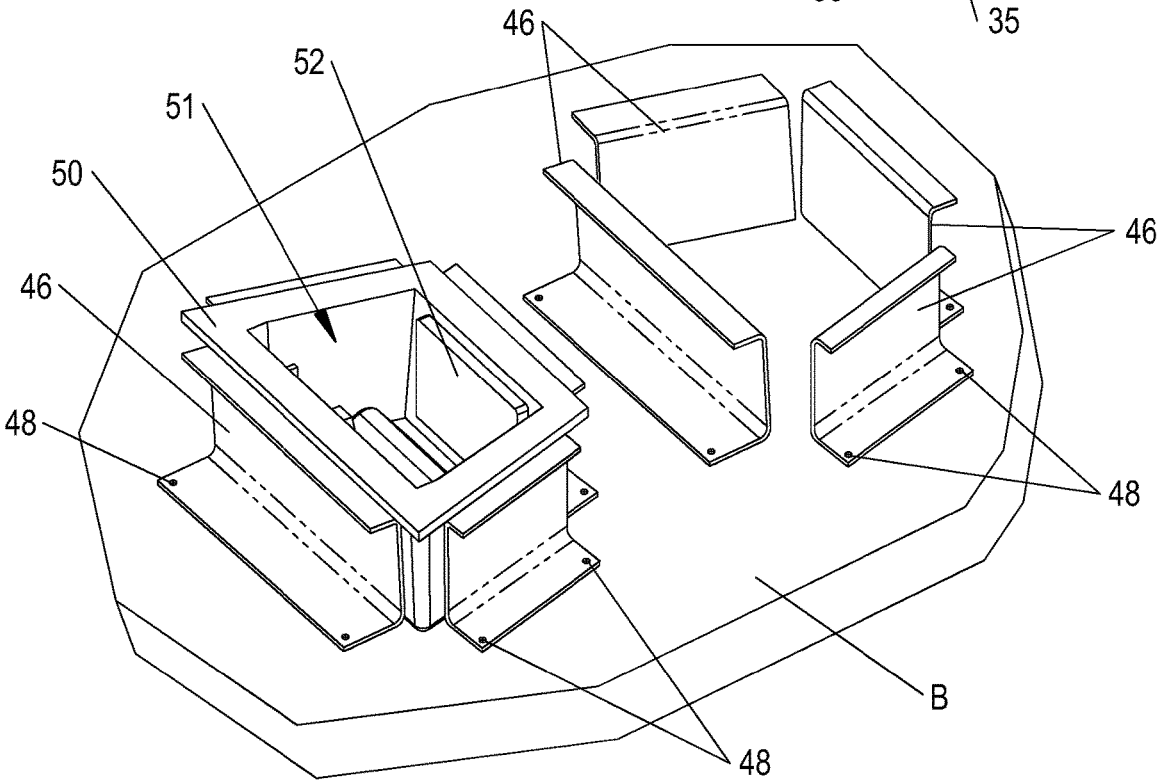
FIG. 6 is a perspective view of a production board having a plurality of support frames with a mold inserted in one of the support frames.
Figure 7:
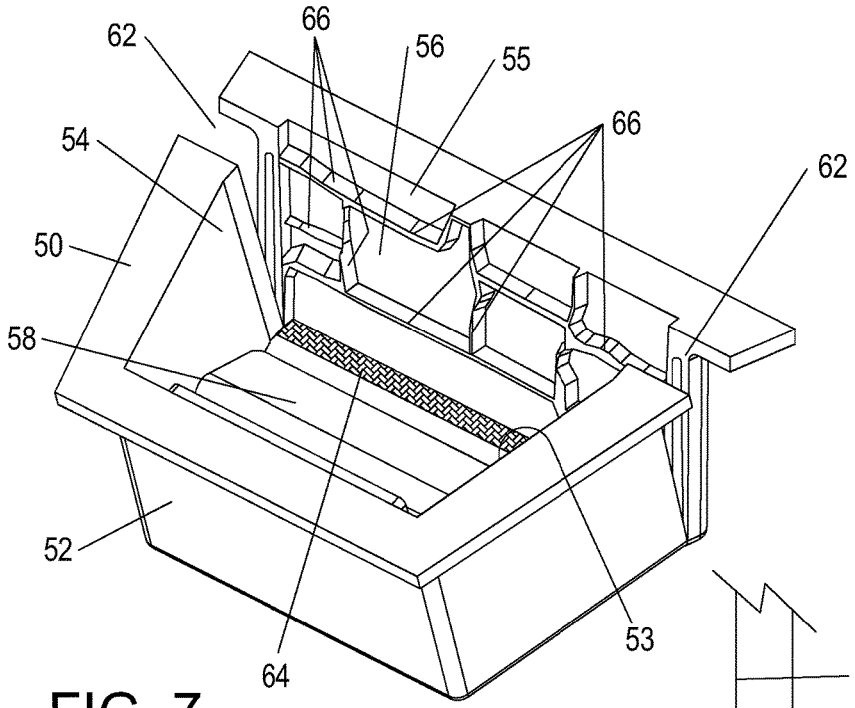
FIG. 7 is a perspective view of a preferred form of mold including a V-shaped slot at each end of the mold adjacent to its front wall.
Figure 8:
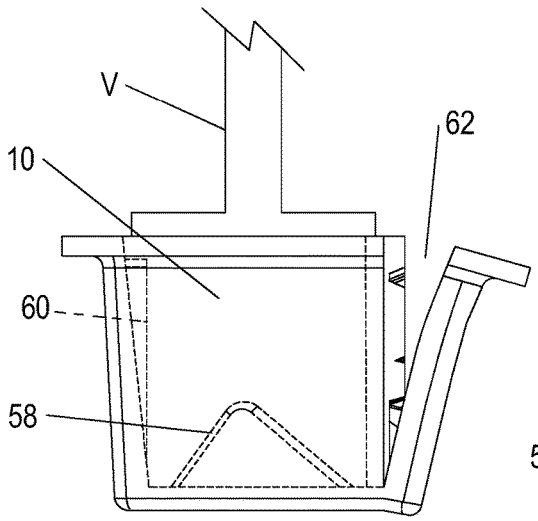
FIG. 8 is a side view of a mold filled with concrete beneath a vacuum tool.

As illustrated in FIGS. 6-8, the concrete blocks are formed by introduction of a concrete mixture consisting of aggregate sand, cement, water, and water-reducing admixtures, with or without iron oxide color. The minimum strength of the concrete is on the order of 4,000 psi. Each mold 50 is preferably of a rubber or rubber-like composition having a central cavity 51 of generally trapezoidal configuration defined by a back wall 52, opposite sides 53, 54 and a front textured wall 55, the walls 52-54 being tapered on both sides to facilitate ease of removal of the hardened concrete from the rubber mold as well as from a production board B. In turn, front wall 55 has an inner face of a stone texture which is duplicated from natural stone. The stone texture is transferred to the mold using a multi-step process combining natural stone, liquid rubber or any liquefied material that will harden to duplicate the texture formed by rubber. A raised portion 58 in the bottom wall of the mold is of elongated triangular configuration and is shaped to form the void or cavity 24 extending from end-to-end in each block; and a raised portion 60 in the rear wall 52 is of elongated generally triangular configuration and results in the cavity 22 in the rear surface of each block.

In a preferred method of manufacture, one or more rubber molds 50 are placed on a standard production board B which can be of various sizes depending upon the manner in which concrete is placed in each mold. For each rubber mold 50, in order to maintain the desired shape, one well known procedure is to utilize a BFS SlabFlex® machine. Any other type of machinery that produces wet cast products may be used as well. Any mold configuration of one or more molds can be mounted on a board B or platform prior to placing concrete in the molds. The molds are positioned so that the textured front wall surface 56 is in a vertical position. Support frames 46 are anchored by screws 48 on the production board B in surrounding relation to the mold during concrete placement. The frames 46 are tight enough to prevent the vertical keyways 62 cut in the mold from opening and allowing concrete to leak through the cuts as hereinafter described in more detail.

Preliminary to placement of the concrete in each mold, a form release agent is applied to the interior of the mold to prevent the concrete from sticking to the mold and prevent bugholes from occurring. Preferably, a water-based release agent is used. The inner front wall surface of each mold is surfaced with a different brick or rock orientation. The stone texture may be duplicated from a variety of different styles of natural rock while still maintaining the overall shape of the block.

The mold may also have a series of intersecting or crossed ridges or ribs 66 projecting inwardly from a common support surface or mat which is secured to the inner front wall surface of the mold. The ridges are of sufficient rigidity to resist bending when the concrete is poured into the mold so as to form joints or spacing between the individual bricks or rocks very much similar in appearance to bricks or stones and mortar, and the thickness and depth of each ridge may be varied as illustrated. In addition, the wet cast machine allows use of multiple colors of concrete to produce a realistic looking natural stone color. A base color with an accent color can be utilized to provide the naturally variegated look of real stone.

Once the molds are placed in the production board, the production board B is then advanced through the filling apparatus for the type of concrete placement equipment that is used to fill the mold with concrete. A preferred approach is to fill the mold in the mold cavity by pouring wetcast concrete into the mold cavity. The SlabFlex® machine permits use of two or more colors of concrete to produce a realistic looking natural stone color, and the entire matrix of the concrete is colored concrete. A base color with an accent color may be used to provide the naturally variegated look of real stone or basic gray concrete without color may be used. The production board B is then run through various vibration cycles to densify and level the concrete in the rubber mold followed by smoothing the top surface by use of a hand cement finishing tool and placing the production board B and molds full of concrete in a suitable curing area during the hardening phase which is normally in the range of 12-20 hours depending upon the type of concrete mixture used and the size of the mold.

Figure 9:
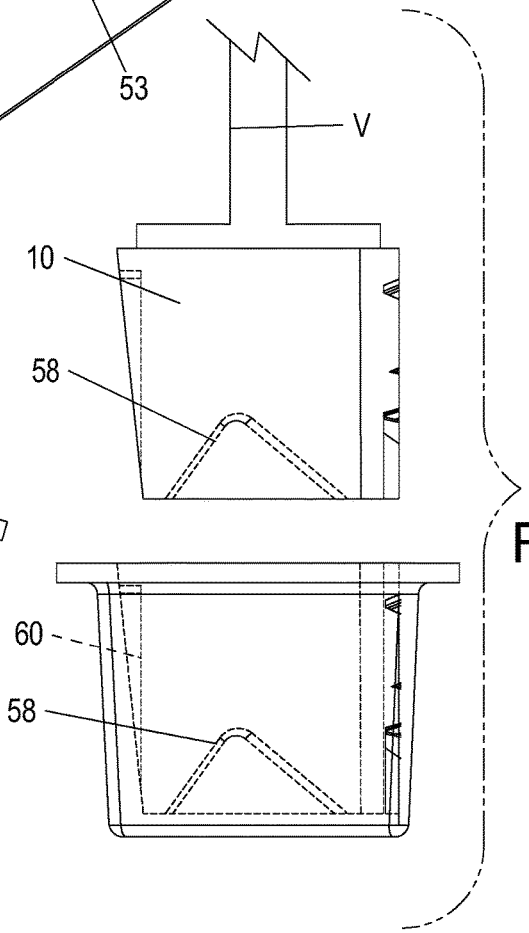
FIG. 9 is an exploded view of the mold shown in FIG. 8 with the cured block being removed with the aid of the vacuum tool.

After curing, each concrete block is removed from the mold and typically is done by hand or using a vacuum demolding device, as shown in FIGS. 8 and 9. This is done by removing the mold and concrete block from the frame 46 using the vacuum, followed by using a manual process and removing the remainder of the concrete block. The mold may be peeled off of the textured wall of the mold along the keyways 62 or hinged portions of the mold as shown in FIGS. 8 and 9. In this way, the textured wall 56 may be manually peeled away from the textured face to preserve the three-dimensional configuration of the textured wall. In other words, the keyways 62 permit hinging of the rubber mold to facilitate removal of the hardened concrete. The rubber molds incorporate a reinforced mesh fabric or strap 64 embedded within the rubber so as to provide reinforcement to the keyways 62 and to prevent tearing at the bottom of the mold. Reversing the mold and allowing the block to be pulled out using gravity is another form of removal. The mold is then placed back into the frames 46 on the production board B.

In the removal process it will be appreciated that the trapezoidal or downwardly tapered configuration of the sidewalls and rear walls greatly facilitate removal of each block along with the formation of voids 22 and 24, particularly the void or cavity 22 in the rear wall surface. In addition, the tapering of the sidewalls 17 and 18 rearwardly away from the front wall 12 enables much greater latitude in the formation of each wall into linear, curved, square or rectangular shapes.

Figure 10:
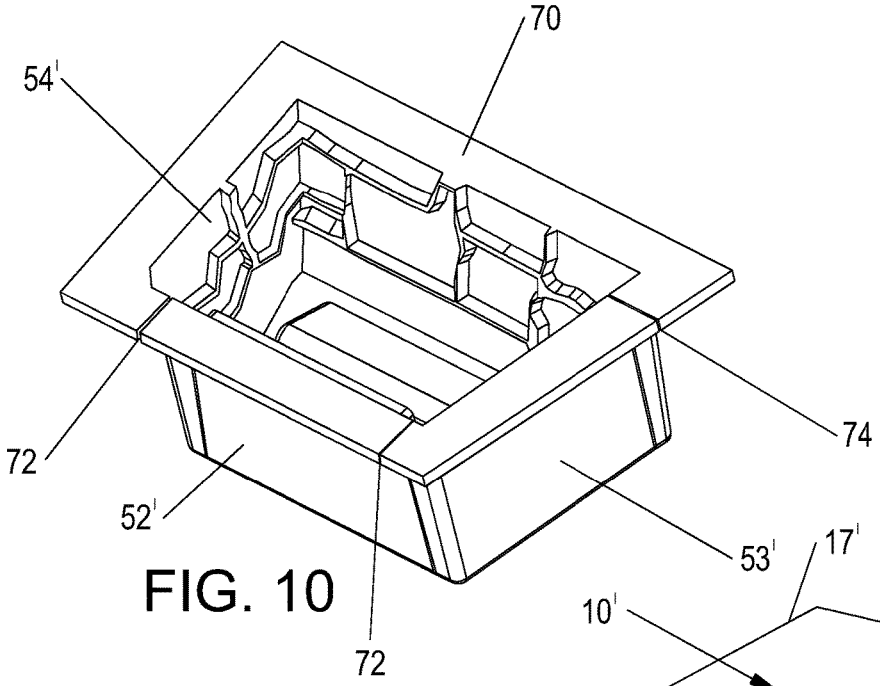
FIG. 10 is a perspective view of a modified form of mold having textured surfaces along the front and end of the interior of the mold.
Figure 11:
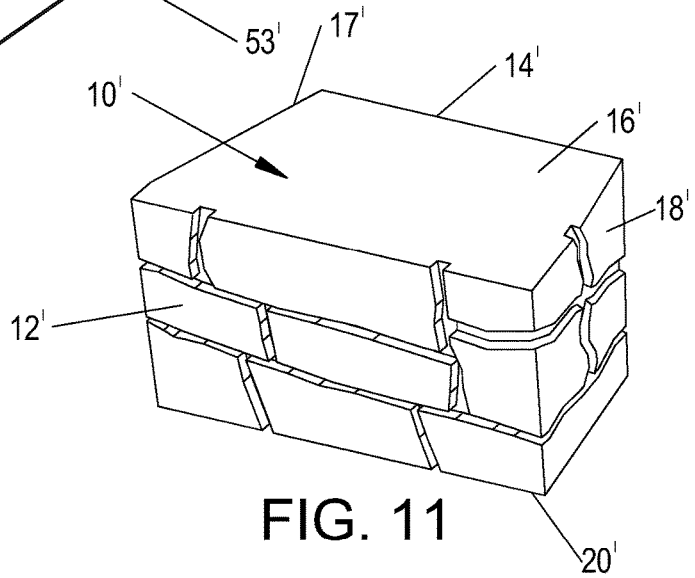
FIG. 11 is a perspective view of the resultant block formed in the mold of FIG. 10.

FIGS. 10 and 11 are directed to a modified form of mold 70 which conforms in all respects to the mold 50 and like parts are correspondingly enumerated to the mold illustrated in FIG. 7. The major departure is in the formation of a textured surface at one end 54' and the location of keyways 72 at opposite ends of the front wall 52' opposite to the textured surface in the front wall 55. An additional keyway 74 is formed in the opposite end wall 53' to the textured end surface 54'. In this way, upon completion of the casting process curing of the concrete block within the mold, both walls 52' and 53' may be peeled away from the rear wall surface 14' and the end wall opposite to the textured wall surface 54'. The block 10' is illustrated in FIG. 11 and comprises a front textured wall surface 12' and a rear wall surface 14' which is tapered downwardly from top horizontal surface 16'. Similarly, opposite sidewall 17' tapers downwardly from the top surface 16', and along with the front, rear sidewall surfaces 12', 14' and 18' terminate in the bottom horizontal surface 20' which is parallel to the top surface 16'. The rear surface 14' is formed with a cavity (not shown) and the bottom surface is formed with a cavity that extends a partial length of the bottom surface 20' due to the presence of the sidewall 18'.

Although preferred and modified forms or embodiments are herein set forth and described, the above and other modifications and changes may be made as well as their intended application for uses other than retaining walls without departing from the spirit and scope.

We claim:

1. A method for molding a concrete block comprising the steps of:

providing a mold comprising:

an outer fixed, rigid form having upstanding front and rear walls and upstanding opposite end walls; and an elastomeric insert having a cavity defining front and rear wall surfaces and opposite side wall surfaces, said elastomeric insert removably inserted into said form, at least one of said front and side wall surfaces having a desired texture simulating a brick or stone to a block to be cast in said cavity, said elastomeric insert comprising an elastomeric hinge that couples either the front or end wall surface to a bottom of the elastomeric insert;

filling said cavity with a wet cast colored concrete through an upper opening into said cavity;

vibrating said mold to densify and level out the concrete in said mold;

curing said concrete in said mold over a predetermined time interval to form a hardened block of concrete;

removing said elastomeric insert from said outer fixed, rigid form; and removing said block from said elastomeric insert after removing said elastomeric insert from said outer fixed, rigid form, wherein removing said block from said elastomeric insert includes hinging the front or end wall surface of the elastomeric insert, relative to the bottom of the elastomeric insert, about the elastomeric hinge to peel the front or end wall surface of the elastomeric insert from at least a portion of the block.

2. The method according to claim 1 comprising manually removing said hardened block from said mold by peeling at least one of said textured front and side wall surfaces of said elastomeric insert of said mold away from said block followed by removing a remainder of said block from said mold.

3. The method according to claim 1 comprising cutting keyways vertically along opposite ends of at least one of said textured front and end wall surfaces, the keyways forming vertically-abutting seams.

4. The method according to claim 1 comprising adding colorant to the wet cast concrete prior to said filling of said cavity.

5. The method according to claim 1, wherein the rigid form comprises a production board; and wall support frames removably attached to the production boards, the wall support frames configured to support walls of said removable elastomeric insert.

6. The method according to claim 5, wherein the wall support frames are attached to the production board by screws.

7. The method according to claim 1, wherein the mold comprises inwardly projecting ridges that define features of the block.

8. The method according to claim 1, wherein removing said block from said mold comprises:

reversing said elastomeric insert such that said upper opening is facing downward; and allowing said block to be removed by gravity.

9. The method according to claim 1, comprising peeling both of said textured front and end wall surfaces by hinging both of said textured front and side wall surfaces along said hinge at said bottom of said mold.

10. The method according to claim 1, wherein the rigid form comprises a production board, and the upstanding front and rear walls and upstanding opposite end walls are removably attached to the production board in a fixed position, the front and rear walls and opposite end walls configured to support respective walls of the elastomeric insert while adjacent edges of the walls are separated by a fixed distance such that none of the upstanding front, rear, and opposite end walls are in direct contact with one another.

11. A method for molding a concrete block comprising:

providing a mold comprising:

providing an outer fixed, rigid form having upstanding front and rear walls and opposite end walls arranged in a trapezoidal configuration; and an elastomeric insert having a trapezoidal cavity defining front and rear wall surfaces and opposite side wall surfaces removably inserted into said form, at least one of said front and end wall surfaces having a texture simulating a brick or stone to a block to be cast in said cavity, wherein a reinforcing strap extends along an elastomeric hinge between at least one of said textured front and end wall surfaces and a bottom of said mold;

filling said cavity with a wet cast colored concrete through an upper opening into said cavity, and;

vibrating said mold to densify and level out the concrete in said mold;

curing said concrete in said mold over a predetermined time interval to form a hardened concrete block; and removing said block from said mold, wherein removing said block from said mold comprises manually removing said hardened block from said mold by peeling said at least one of textured front and end wall surfaces of said mold away from said block followed by removing a remainder of said block from said mold, wherein peeling at least one of said textured front and end wall surfaces comprises hinging said wall, relative to the bottom of the elastomeric insert, about said elastomeric hinge at said bottom of said mold.

12. The method according to claim 11, wherein said reinforcing strap comprises a meshed fabric embedded within the elastomeric insert.

13. A method for molding a concrete block, the method comprising:

filling a cavity of an elastomeric insert with a wet cast concrete, said elastomeric insert positioned at least partially in an outer rigid form having upstanding front and rear walls and opposite end walls, the elastomeric insert removably positioned in the outer rigid form, at least one of said front and end wall surfaces having a texture that simulates a brick or stone, wherein the elastomeric insert comprises a first keyway and a second keyway that extend vertically along opposite ends of at least one of said textured front and end wall surfaces, the first keyway and the second keyway forming a first vertically-abutting seam and a second vertically-abutting seam respectively, wherein a reinforcing strap extends along an elastomeric hinge between at least one of said textured front and end wall surfaces and a bottom of said mold;

vibrating said elastomeric insert and said form to densify and level out the concrete in said mold;

curing said concrete in said elastomeric insert over a predetermined time interval to form a cured block; and removing said cured block from said elastomeric insert after removing said elastomeric insert from said outer fixed, rigid form, wherein removing said block from said elastomeric insert includes hinging the front or end wall surface, relative to the bottom of the elastomeric insert, about the elastomeric hinge to peel the front or end wall surface from at least a portion of the block.

14. The method according to claim 13, further comprising removing said block from said elastomeric insert by peeling a wall of said elastomeric insert away from said block followed by removing a remainder of said block from said elastomeric insert.

15. The method according to claim 14, further comprising peeling at least one of said textured front and end wall surfaces by hinging one of said textured front and end wall surfaces along said elastomeric hinge at a bottom of said elastomeric insert.

16. The method according to claim 13, wherein the elastomeric insert comprises a third keyway that extends vertically along an end of a wall surface opposite the second keyway, the third keyway forming a third vertically-abutting seam.

17. The method according to claim 13, further comprising adding colorant to the wet cast concrete prior to said filling of said cavity.

18. The method according to claim 13, further comprising positioning the elastomeric insert within the outer rigid form, the outer rigid form comprising;

a production board; and removable wall support frames fixedly-mounted to the production board, the removable wall support frames configured to support walls of the elastomeric insert, adjacent edges of respective wall support frames separated by a fixed distance such that none of the wall support frames are in direct contact with any other wall support frame.

19. The method according to claim 18, wherein removing said cured block from said elastomeric insert comprises removing said elastomeric insert from said removable wall support frames while the cured block is retained within the elastomeric insert.

20. The method according to claim 13, wherein the elastomeric insert comprises inwardly projecting ridges that define features of the block.

* * * * *